US011676747B2

(12) United States Patent
Hagiwara et al.

(10) Patent No.: US 11,676,747 B2
(45) Date of Patent: Jun. 13, 2023

(54) PERMANENT MAGNET, ROTARY ELECTRICAL MACHINE, AND VEHICLE

(71) Applicant: KABUSHIKI KAISHA TOSHIBA, Tokyo (JP)

(72) Inventors: Masaya Hagiwara, Yokohama Kanagawa (JP); Yosuke Horiuchi, Ota Tokyo (JP); Shinya Sakurada, Shinagawa Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 16 days.

(21) Appl. No.: 17/375,064

(22) Filed: Jul. 14, 2021

(65) Prior Publication Data

US 2021/0343457 A1 Nov. 4, 2021

Related U.S. Application Data

(63) Continuation of application No. 16/283,879, filed on Feb. 25, 2019, now abandoned, which is a (Continued)

(51) Int. Cl.

| | |
|---|---|
| ***H01F 1/055*** | (2006.01) |
| ***B22F 3/24*** | (2006.01) |
| ***C22C 38/16*** | (2006.01) |
| ***C22C 38/14*** | (2006.01) |
| ***C22C 38/10*** | (2006.01) |
| ***H01F 41/02*** | (2006.01) |

(Continued)

(52) U.S. Cl.

CPC ..... *H01F 1/0557* (2013.01); *B22F 3/24* (2013.01); *B22F 2003/248* (2013.01); *B22F 2998/10* (2013.01); *B22F 2999/00* (2013.01); *C22C 19/07* (2013.01); *C22C 38/005* (2013.01); *C22C 38/10* (2013.01); *C22C 38/14* (2013.01); *C22C 38/16* (2013.01); *H01F 41/0266* (2013.01)

(58) Field of Classification Search

CPC ..... H01F 1/0557; B22F 2003/248

See application file for complete search history.

(56) References Cited

U.S. PATENT DOCUMENTS

| | | | |
|---|---|---|---|
| 4,484,957 | A | 11/1984 | Higuchi et al. |
| 2002/0054825 | A1 | 5/2002 | Sukaki et al. |

(Continued)

FOREIGN PATENT DOCUMENTS

| | | | | |
|---|---|---|---|---|
| CN | 106575568 | | 4/2017 | |
| JP | 63157844 | A * | 6/1988 | ..... H01F 1/0557 |

(Continued)

OTHER PUBLICATIONS

JP-H058562-B2 English language translation (Year: 1993).*

(Continued)

*Primary Examiner* — Anthony J Zimmer
*Assistant Examiner* — Sean P. O'Keefe
(74) *Attorney, Agent, or Firm* — Amin, Turocy & Watson, LLP

(57) ABSTRACT

A permanent magnet is expressed by a composition formula: $R_pFe_qM_rCu_sCo_{100-p-q-r-s}$. The magnet includes a crystal grain having a main phase including a $TbCu_7$ crystal phase, and a volume ratio of the $TbCu_7$ crystal phase to the main phase is 95% or more.

6 Claims, 4 Drawing Sheets

Related U.S. Application Data continuation of application No. PCT/JP2017/033494, filed on Sep. 15, 2017.

(51) Int. Cl.

| | |
|---|---|
| *C22C 38/00* | (2006.01) |
| *C22C 19/07* | (2006.01) |

(56) References Cited

U.S. PATENT DOCUMENTS

| | | | | |
|---|---|---|---|---|
| 2005/0189042 | A1 | 9/2005 | Ohashi | |
| 2013/0082559 | A1* | 4/2013 | Hagiwara | H01F 1/0557 310/152 |
| 2013/0241333 | A1 | 9/2013 | Horiuchi et al. | |
| 2015/0143952 | A1 | 5/2015 | Horiuchi et al. | |
| 2015/0194246 | A1* | 7/2015 | Horiuchi | H02K 1/2766 310/152 |
| 2015/0270040 | A1 | 9/2015 | Horiuchi et al. | |
| 2017/0148568 | A1 | 5/2017 | Sanada et al. | |

FOREIGN PATENT DOCUMENTS

| | | |
|---|---|---|
| JP | 02-294447 | 12/1990 |
| JP | 05-008562 | 2/1993 |
| JP | 05-082319 | 4/1993 |
| JP | 2002-083707 | 3/2002 |
| JP | 2005-243884 | 9/2005 |
| JP | 2008-029148 | 2/2008 |
| JP | 2008-043172 | 2/2008 |
| JP | 4448713 | 4/2010 |
| JP | 2011-114236 | 6/2011 |
| JP | 6081254 | 2/2017 |
| KR | 10-2017-0021878 | 2/2017 |
| WO | 2016/151622 | 9/2016 |

OTHER PUBLICATIONS

International Search Report and Written Opinion for International Application No. PCT/JP2017/033494 dated Dec. 19, 2017, 10 pages.

Non-Final Office Action for U.S. Appl. No. 16/283,879 dated Mar. 27, 2020.

Final Office Action for U.S. Appl. No. 16/283,879 dated Sep. 4, 2020.

Non-Final Office Action for U.S. Appl. No. 16/283,879 dated Apr. 20, 2021.

* cited by examiner

PERMANENT MAGNET, ROTARY ELECTRICAL MACHINE, AND VEHICLE

CROSS-REFERENCE TO RELATED APPLICATIONS

This application is a Continuation of U.S. patent application Ser. No. 16/283,879 filed on Feb. 25, 2019, which is a Continuation of prior International Application No. PCT/JP2017/033494 filed on Sep. 15, 2017; the entire contents of all of which are incorporated herein by reference.

FIELD

Embodiments described herein relate generally to a permanent magnet, a rotary electrical machine, and a vehicle.

BACKGROUND

As an example of a high-performance permanent magnet, rare-earth magnets such as a Sm—Co-based magnet and a Nd—Fe—B-based magnet are known. These magnets which are currently mass-produced contain a large amount of Fe or Co. Fe and Co contribute to an increase in saturation magnetization. Further, rare-earth elements such as Sm and Nd are also indispensable. Owing to the behavior of 4f electrons of the rare-earth elements, these magnets have high magnetic anisotropy. These factors make the rare-earth magnets strong magnets having both high magnetization and high coercive force. Accordingly, they have found their application in various motors requiring downsizing and improved efficiency.

In recent years, with the aim of improving the efficiency of a motor, active studies have been made on a memory motor having a variable magnetic flux. Typically, a memory motor uses two kinds of magnets, a variable magnet whose magnetic flux is variable according to an operation state of the motor and a stationary magnet with invariable magnetic flux. Conventional variable magnets are Al—Ni—Co magnets, but since high magnetic flux is also required of variable magnets in order to widen a magnetic flux variable width, and the application of rare-earth magnets thereto is being considered.

Determining factors of the performance of a variable magnet are, for example, residual magnetization, coercive force, and squareness. Increasing the residual magnetization results in an increase in the maximum value of magnetic flux. The coercive force needs to be controlled to an optimum value in an about 100 to 500 kA/m range depending on the design of a motor or the like. The purpose of this is to facilitate increasing/decreasing the magnetic flux of the variable magnet by an external magnetic field. High squareness is also necessary for maintaining an increase/decrease width of the magnetic flux.

Out of rare-earth magnets, a Sm—Co-based magnet is suitable as a variable magnet because of its pinning-type coercive force mechanism. This is because, in a minor loop of magnetic properties, a region where a magnetization change is small is obtained widely, enabling to widen a magnetic flux variable width.

What is effective for increasing the magnetization of the Sm—Co-based magnet is to replace part of Co by Fe and increase the Fe concentration. However, if having a composition with a high Fe concentration, the Sm—Co-based magnet has a difficulty in having controlled coercive force and exhibiting excellent squareness. Such circumstances have given rise to a demand for a technique that achieves high residual magnetization and high squareness while keeping controllability of coercive force in a Sm—Co-based magnet with a high Fe concentration.

DETAILED DESCRIPTION

Figure 1:
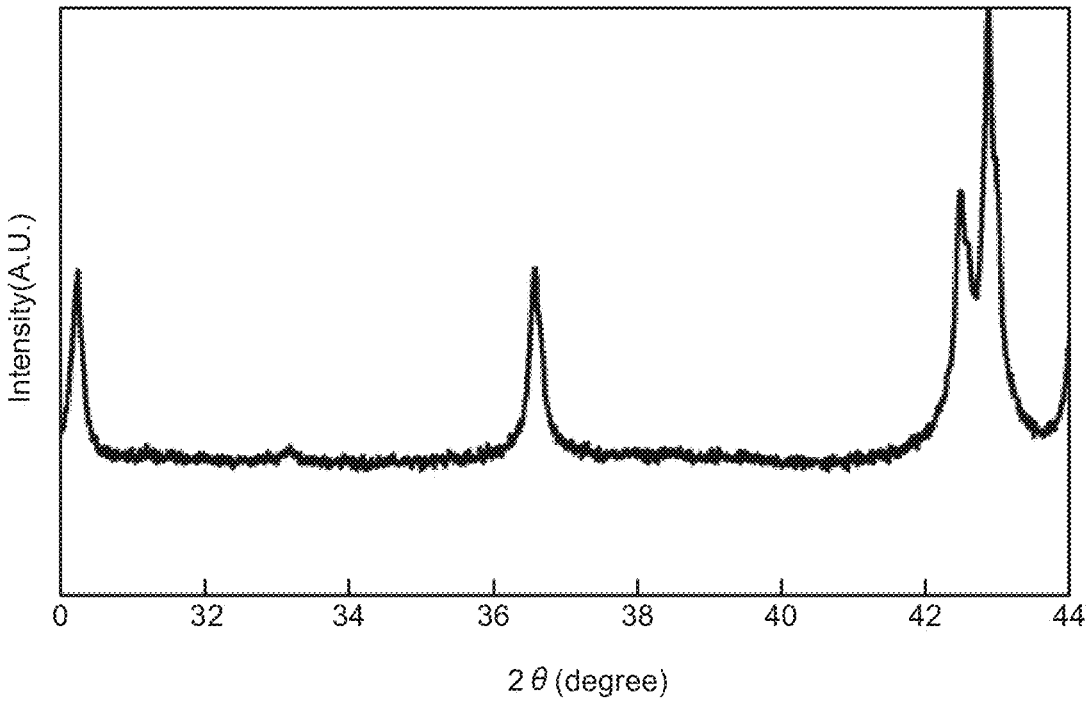
FIG. 1 is a chart illustrating an example of an X-ray diffraction pattern of a permanent magnet.

A permanent magnet of an embodiment is expressed by a composition formula: $R_pFe_qM_rCu_sCo_{100-p-q-r-s}$. The magnet includes a crystal grain having a main phase including a $TbCu_7$ crystal phase, and a volume ratio of the $TbCu_7$ crystal phase to the main phase is 95% or more.

Embodiments will be hereinafter described with reference to the drawings. It should be noted that the drawings are schematic, and for example, a relation between thickness and planar dimension, a thickness ratio among layers, and so on may be different from actual ones. Further, in the embodiments, substantially the same constituent elements are denoted by the same reference signs and descriptions thereof will be omitted.

First Embodiment

A permanent magnet of the embodiment is expressed by the following composition formula, $$R_pFe_qM_rCu_sCO_{100-p-q-r-s}$$

(where R is at least one element selected from the group consisting of rare-earth elements, M is at least one element selected from the group consisting of Zr, Ti, and Hf, and p, q, r, and s satisfy, in at. %, $10.5 \le p \le 12.5$, $25 \le q \le 40$, $0.88 \le r \le 4.5$, and $3.5 \le s \le 10.7$ respectively).

The R element imparts high magnetic anisotropy and high coercive force to the permanent magnet. The R element is one kind of rare earth element or more. The R element is more preferably at least one element selected from, for example, yttrium (Y), samarium (Sm), cerium (Ce), neodymium (Nd), and praseodymium (Pd), and particularly preferably is Sm. The R element containing 50 at. % or more of Sm can enhance the performance, in particular, the coercive force, of the permanent magnet with good reproducibility. More preferably, 70 at. % or more, further 90 at. % or more of the R element is Sm.

The content of the R element is, for example, not less than 10.5 at. % nor more than 12.5 at. %. If the content of the R element is less than 10.5 at. %, a large amount of an α-Fe phase precipitates, leading to insufficient coercive force. On the other hand, if the content of the R element is over 12.5 at. %, saturation magnetization greatly decreases. The content of the R element is preferably not less than 10.9 at. % nor more than 12.0 at. %, and more preferably not less than 11.0 at. % nor more than 11.6 at. %.

The M element is at least one element selected from the group consisting of titanium (Ti), zirconium (Zr), and hafnium (Hf). Blending the M element makes it possible for the coercive force to be exhibited in a high Fe concentration composition. The content of the M element is not less than 0.88 at. % nor more than 4.5 at. %. If the content of the M element is less than 0.88 at. %, the effect of increasing the Fe concentration is small, and if it is over 4.5 at. %, a phase containing an excessively large amount of the M element is generated, which is likely to lower the magnetic properties. The content of the M element is preferably not less than 1.14 at. % nor more than 3.58 at. %, and more preferably not less than 1.55 at. % nor more than 2.23 at. %.

The M element may be any of Ti, Zr, and Hf, but preferably contains at least Zr. In particular, the M element containing 50 at. % or more of Zr can have a higher effect of increasing the coercive force. On the other hand, an amount of Hf, which is especially expensive among the M elements, is preferably as small as possible even when Hf is used. The content of Hf is preferably less than 20 at. % of the M element.

Copper (Cu) causes the permanent magnet to exhibit the coercive force. The content of Cu is not less than 3.5 at. % nor more than 10.7 at. %. Being a non-magnetic element, Cu greatly lowers the magnetization if its content is over 10.7 at. %. If its content is less than 3.5 at. %, it is difficult to obtain high coercive force. The content of Cu is preferably not less than 3.9 at. % nor more than 9.0 at. %, more preferably not less than 4.3 at. % nor more than 6.0 at. %, and still more preferably not less than 5.0 at. % nor more than 5.6 at. %.

Iron (Fe) is responsible mainly for the magnetization of the permanent magnet. The permanent magnet containing a large amount of Fe can have higher saturation magnetization. However, an excessively high content of Fe results in a decrease in the coercive force due to the precipitation of the $\alpha$-Fe phase, and so on. The content of Fe is set to a range of not less than 25 at. % nor more than 40 at. %. The Fe content is more preferably not less than 26 at. % nor more than 36 at. %, and still more preferably not less than 29 at. % nor more than 35 at. %, and yet more preferably not less than 30 at. % nor more than 33 at. %.

Cobalt (Co) not only is responsible for the magnetization of the permanent magnet but also is an essential element for causing the coercive force to be exhibited. Further, Co whose content is high increases a Curie temperature and improves the heat stability of the permanent magnet. These effects are small if the Co content is small. However, the permanent magnet excessively containing Co has a relatively decreased content of Fe, which may lead to a decrease in the magnetization. The content of Co is set within a range determined by p, q, r, and t (100-p-q-r-t).

Part of Co may be replaced by at least one kind of element A selected from the group consisting of nickel (Ni), vanadium (V), chromium (Cr), manganese (Mn), aluminum (Al), silicon (Si), gallium (Ga), niobium (Nb), tantalum (Ta), and tungsten (W). These substitution elements contribute to an improvement in the magnetic properties, for example, the coercive force. However, since the excessive replacement of Co by the element A may lead to a decrease in the magnetization, a substitution amount by the element A is set to a range of 20 at. % or less of Co.

The composition of the permanent magnet is measured by, for example, a high-frequency ICP (Inductively Coupled Plasma) emission spectrochemical analysis method, SEM-EDX (SEM-Energy Dispersive X-ray Spectroscopy), or TEM-EDX (Transmission Electron Microscope-EDX).

The above-described permanent magnet includes a sintered compact having a two-dimensional metal structure containing crystal grains each having a main phase and crystal grain boundaries (also called grain boundary phases) of the crystal grains. The main phase is defined as a phase having the maximum volume ratio out of all the constituent phases. A ratio of the main phase in all the constituent phases is 70% by volume or more, and preferably 90% by volume or more. The metal structure is observed with, for example, SEM (Scanning Electron Microscope).

The grain boundary phases are around the crystal grains. A melting point of the grain boundary phases is lower than that of the main phases. The grain boundary phase includes, for example, a $Ce_2Ni_7$ crystal phase (2-7 crystal phase) and a $CaCu_5$ crystal phase (1-5 crystal phase).

The constituent phases of the crystal grains are identified based on an XRD pattern obtained by XRD (X-ray Diffraction) analysis. FIG. 1 is a chart illustrating an example of the X-ray diffraction pattern of the permanent magnet. The XRD pattern illustrated in FIG. 1 has a peak ascribable to a hexagonal $TbCu_7$ crystal phase (1-7 crystal phase). That is, the main phase has the $TbCu_7$ crystal phase. A relative intensity of a peak ascribable to a $Th_2Nn_{17}$ crystal phase whose $2\theta$ is not less than 37.5 degrees nor more than 38.5 degrees, with respect to the maximum peak ascribable to the $TbCu_7$ crystal phase is preferably 0.4 or less. The 0.4 relative intensity or less indicates that a volume ratio of the $Th_2Zn_{17}$ crystal phase out of the constituent phases of the crystal grain is small or zero.

In the permanent magnet of the embodiment, a volume ratio of the 1-7 crystal phase out of the constituent phases of the main phase is 95% or more. That is, the aforesaid main phase practically has a single-phase structure of the 1-7 crystal phase.

The volume ratios of the phases of the metal structure are comprehensively determined using the combination of the observation with an electron microscope or an optical microscope and the X-ray diffraction or the like, for instance, and can be found by an areal analysis method of an electron micrograph of a cross section of the permanent magnet. This cross section of the permanent magnet is a cross section at a substantially center of a surface having the largest area in a sample.

Figure 2:
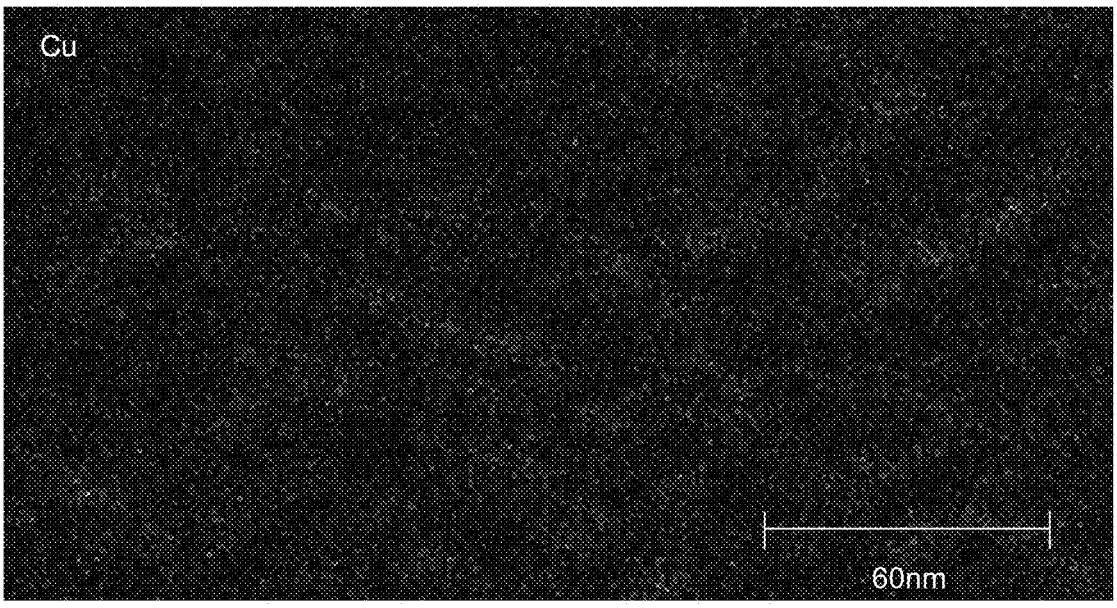
FIG. 2 is a Cu mapping image obtained from a TEM-EDX analysis of a 1-7 crystal phase.

FIG. 2 is a chart illustrating a Cu mapping image obtained from the TEM-EDX analysis of the 1-7 crystal phase. As illustrated in FIG. 2, the 1-7 crystal phase has a variation in the Cu concentration. A variance of the Cu concentration of the 1-7 crystal phase is preferably 0.7 or more.

As a SmCo-based magnet having a high iron concentration, a $Sm_2Co_{17}$-based magnet (2-17 magnet) is known. In the 2-17 magnet, a cell phase composed of a $Th_2Zn_{17}$ crystal phase and a cell wall phase composed of a $CaCu_5$ crystal phase form a cell structure, and by the cell wall phase functioning as a domain wall pinning site, the coercive force is exhibited.

On the other hand, in the permanent magnet of the embodiment, the cell structure which serves as an origin of the coercive force as is observed in the 2-17 magnet is not observed. However, the present inventors have found out that, in a single grain having a 1-7 crystal phase, the 1-7 crystal phase has a variation in the Cu concentration. A region having a high Cu concentration functions as a domain wall pinning site, and because of this, it is thought that the coercive force is exhibited. Such a coercive force exhibiting mechanism is referred to as a coercive force exhibiting mechanism of a domain wall pinning type. Consequently, the permanent magnet of the embodiment presents a pinning-type initial magnetization curve. In the 2-17 magnet, since the magnetization of the $CaCu_5$ crystal phase of the cell wall phase is low in magnetization, forming the cell structure in order to make the coercive force exhibited results in a decrease in the magnetization. On the other hand, not having the cell structure, the permanent magnet of the embodiment is capable of exhibiting the coercive force while maintaining high magnetization. For example, it is possible to achieve the residual magnetization of 1,21 T or more while controlling the coercive force to not less than 100 kA/m nor more than 500 kA/m. This permanent magnet is suitable as a variable magnet, for instance.

In the coercive force exhibiting mechanism of the domain wall pinning type, even the generation of a magnetization-reversal nucleus which is a starting point of magnetization reversal does not cause domain wall displacement unless an external field higher than a pinning potential is applied. Therefore, a dominant determining factor of the magnitude of the coercive force is an existing form of the pinning site.

Increasing the Fe concentration as well as replacing part of Co by Fe is effective to increase the magnetization of an R—Co-based permanent magnet. Therefore, the permanent magnet of the embodiment contains not less than 25 at. % nor more than 40 at. % Fe. However, the permanent magnet, if having a high Fe concentration, does not easily exhibit the coercive force and has a difficulty in having good squareness because a magnetization-reversal nucleus is likely to be generated therein, and accordingly is caused to decrease in $(BH)_{max}$.

A possible way for the coercive force to be exhibited in a high iron concentration composition due to the Cu concentrated region may be to increase the Cu concentration. However, since Cu is a non-magnetic element, the magnetization greatly decreases in a composition with a high Cu concentration.

In the permanent magnet of the embodiment, a distribution state of the concentration of Cu functioning as the pinning site is controlled while the Fe and Cu concentrations are set within ranges enabling to maintain sufficient magnetization. This achieves both high magnetization and the coercive force necessary for the variable magnet, in a high iron concentration composition region. That is, it is possible to provide a high-performance variable magnet.

The Cu concentration distribution is measured as follows. The composition of the permanent magnet is analyzed by TEM-EDX. TEM observes a region of not smaller than 100 nm×100 nm nor larger than 400 nm×400 nm at a magnification of ×500,000. An acceleration voltage is preferably 200 kV.

In the TEM-EDX analysis, the composition is measured in a surface portion and an inner portion of a cross section taken at a center portion of the longest side of a surface having the largest area, perpendicularly to the side (perpendicularly to a tangent of the center portion in a case of a curve). Measurement locations are set as follows. First reference lines and second reference lines are drawn in the aforesaid cross section. Starting points of the first reference lines are ½ positions of respective sides of the cross section, and they are drawn perpendicularly to the sides so as to extend inward up to end portions. Starting points of the second reference lines are centers of corner portions of the cross section, and they are drawn so as to equally divide interior angles of the corner portions and so as to extend inward up to end portions. Then, 1% positions of the lengths of the first and second reference lines from the starting points of the reference lines are defined as the surface portion and 40% positions thereof are defined as the inner portion. When the corner portions have curvature because of chamfering or the like, points of intersection of extensions of the adjacent sides are defined as end portions of the sides (the centers of the corner portions). In this case, the measurement locations are set based on the distance not from the points of intersection but from portions in contact with the reference lines.

When the measurement locations are set as above, in a case where the cross section is, for example, a quadrangle, the number of the reference lines is totally eight, with the four first reference lines and the four second reference lines, and the number of the measurement locations is eight in each of the surface portion and the inner portion.

Next, the Cu concentration is measured at a plurality of points in the TEM images. The measurement points are points of intersection of lines equally dividing a longitudinal side and a lateral side forming a measurement surface. The division number of each of the lines is selected such that the number of the measurement points is 20 or more. By calculating the variance of the Cu concentrations obtained at the respective points, it is possible to measure the Cu concentration distribution. The variance is calculated by the following expression, for instance.

$$S^2 = \frac{1}{n}\sum_{i=1}^{n}(x_i - \bar{x})^2 \quad \text{[Math.]}$$

In the expression, $S^2$ represents the variance of the Cu concentration, n represents the number of the measurement points, $X_i$ represents the Cu concentration of each of the measurement points, and/X represents an average value of the Cu concentrations at all the measurement points.

In this embodiment, the variances in all the eight locations in each of the surface portion and the inner portion preferably falls within the aforesaid range, but it suffices if the variances in at least four places or more in each of the surface portion and the inner portion fall within the aforesaid range. In this case, a relation of the surface portion and the inner portion in one reference line is not stipulated.

The Cu concentrated region is in a belt form whose long side is about 10 nm to 100 nm, or in a spherical form whose diameter is about 1 to 10 nm. The aforesaid variance may be achieved by a continuous concentrated region distributed in a space.

Next, an example of a method of manufacturing the permanent magnet will be described. First, an alloy powder containing predetermined elements necessary for synthesizing the permanent magnet is prepared. An example of a method to prepare the alloy powder is to pulverize an alloy ingot fabricated through the casting of molten metal obtained by an arc melting method or a high-frequency melting method. The alloy powder may be prepared by mixing a plurality of powders different in composition, so as to have a desired composition.

Other examples of the method of preparing the alloy powder include a mechanical alloying method, a mechanical grinding method, a gas atomization method, and a reduction diffusion method. Using a strip cast method makes it possible to improve the uniformity of the alloy powder. Further, heat-treating the alloy powder or the alloy material not yet pulverized enables the homogenization of the material. The material can be pulverized using a jet mill, a ball mill, or the like, for instance. Incidentally, pulverizing the material in an inert gas atmosphere or an organic solvent can prevent the oxidation of the powder.

The average particle size of the powder after the pulverization is preferably not less than 2 μm nor more than 8 μm. The average particle size of the powder after the pulverization is more preferably not less than 3 μm nor more than 7.5 μm, still more preferably not less than 4 μm nor more than 7 μm, and yet more preferably not less than 4 5 μm nor more than 6 μm. Setting a ratio of particles whose particle size is 1 μm or less to 1% by volume or less enables to reduce an amount of an oxide. Setting a ratio of particles whose particle size is 10 μm or more to 2% by volume or less enables to reduce a vacancy rate of the sintered compact fabricated by sintering to achieve a sufficient density.

The average particle size of the powder is defined as a value of particle size whose cumulative distribution is 50% (median diameter: d50) in particle size distribution measured by a laser diffraction method or the like. A jet mill is suitable for fabricating such a powder.

Next, the alloy powder is filled in a metal mold placed in an electromagnet and is press-formed into a green compact whose crystal axes are oriented, while a magnetic field is applied thereto. As a forming method, there are a dry forming method and a wet forming method. In the dry forming method, a minute amount of a lubricating oil is preferably added for the purpose of improving the fluidity of the powder and preventing the oxidation of the powder. Examples of the lubricating oil include a silicone oil and a mineral oil.

Next, the aforesaid green compact is sintered by being heat-treated at not lower than 1180° C. nor higher than 1250° C. for not less than 0.5 hours nor more than 15 hours. The heat-treatment at a temperature of lower than 1180° C. results in an insufficient density of the sintered compact. The heat-treatment at a temperature of over 1250° C. may deteriorate the magnetic properties due to, for example, the excessive evaporation of the R element such as Sm in the powder. For example, the heat-treatment temperature is preferably not lower than 1180° C. nor higher than 1220° C., and more preferably not lower than 1190° C. nor higher than 1210° C.

The heat treatment for less than 0.5 hours may not achieve a sufficient density. The heat treatment for over fifteen hours may result in the excessive evaporation of the R element in the powder to deteriorate the magnetic properties. The heat-treatment time is preferably not less than one hour nor more than ten hours, and more preferably not less than one hour nor more than seven hours. In the above sintering, an atmosphere of the heat treatment is preferably a vacuum or an inert atmosphere of argon gas or the like in order to inhibit the oxidation.

The fabricated sintered compact is subjected to solution heat treatment, and after the heat treatment, is quenched at a cooling rate of 150° C./minute or more. This makes it possible for the main phase to be a single phase of the $TbCu_7$ crystal phase (1-7 phase) which is a precursor phase. Further, the temperature of the solution heat treatment may be varied in stages. An atmosphere of all the heat treatments is preferably a vacuum or an inert atmosphere of argon gas or the like.

The temperature of the solution heat treatment is preferably not lower than 1100° C. nor higher than 1180° C. The solution heat treatment at a temperature of lower than 1100° C. or higher than 1180° C. may result in a small ratio of the $TbCu_7$ crystal phase to deteriorate the magnetic properties. The solution heat treatment temperature is preferably not lower than 1110° C. nor higher than 1170° C., for instance.

The solution heat treatment time is preferably not less than one hour nor more than thirty hours. The solution heat treatment for less than one hour is likely to result in insufficient element diffusion to make the constituent phases nonuniform and thus may deteriorate the magnetic properties. The solution heat treatment for over thirty hours may cause the evaporation of the R element in the sintered compact to lower productivity. The solution heat treatment time is more preferably not less than four hours nor more than twelve hours.

Next, aging treatment is applied to the sintered compact having undergone the solution heat treatment to control the Cu concentration distribution. In the aging treatment, the sintered compact is heat-treated at a temperature of not lower than 550° C. nor higher than 680° C. for not less than 1 hour nor more than 100 hours, and thereafter it is preferably gradually cooled down to a temperature of not lower than 20° C. nor higher than 500° C. at a cooling rate of not less than 0.1° C./minute nor more than 5° C./minute, and thereafter cooled down to a room temperature. The aging treatment under such a condition makes it possible to form the Cu concentration distribution while maintaining the $TbCu_7$ crystal phase, making it possible to control the coercive force of the permanent magnet. In order to prevent the oxidation, an atmosphere of the aging treatment is preferably a vacuum or an inert gas atmosphere of argon gas or the like.

The aging treatment at a temperature of lower than 550° C. results in a slow progress of the element diffusion, which does not enable the formation of sufficient Cu concentration distribution. The aging treatment at a temperature of over 680° C. results in the formation of a cell structure in which the $TbCu_7$ crystal phase is two-phase separated into a cell phase and a cell wall phase, which may deteriorate the magnetization. The temperature of the aging treatment is preferably not lower than 600° C. nor higher than 670° C., and more preferably not lower than 610° C. nor higher than 660° C.

The aging treatment for less than one hour may result in the insufficient formation of the Cu concentration distribution or the insufficient element diffusion. On the other hand, when the retention time is over 100 hours, the crystal grains become coarse, and it may not be possible to obtain good magnetic properties. The aging treatment time is more preferably not less than four hours nor more than sixty hours, and still more preferably not less than five hours nor more than forty hours.

A less than 0.1° C./minute cooling rate of the gradual cooling may lead to low productivity to increase the cost. When the cooling rate of the gradual cooling is over 5° C./minute, the sufficient coercive force may not be obtained because the Cu concentration distribution is not sufficiently formed or the element diffusion becomes insufficient. The cooling rate after the aging treatment is preferably not less than 0.5° C./minute nor more than 4° C./minute, and more preferably 1° C./minute nor more than 3° C./minute.

Second Embodiment

The permanent magnet of the first embodiment is also usable as a variable magnet of a variable magnetic flux motor and a variable magnetic flux generator. Where the permanent magnet of the first embodiment is applied to a variable magnetic flux motor, the arts disclosed in Japanese Laid-open Patent Publication No. 2008-29148 and Japanese Laid-open Patent Publication No. 2008-43172 are applicable to the structure and a drive system of the variable magnetic flux motor, for example.

Figure 3:
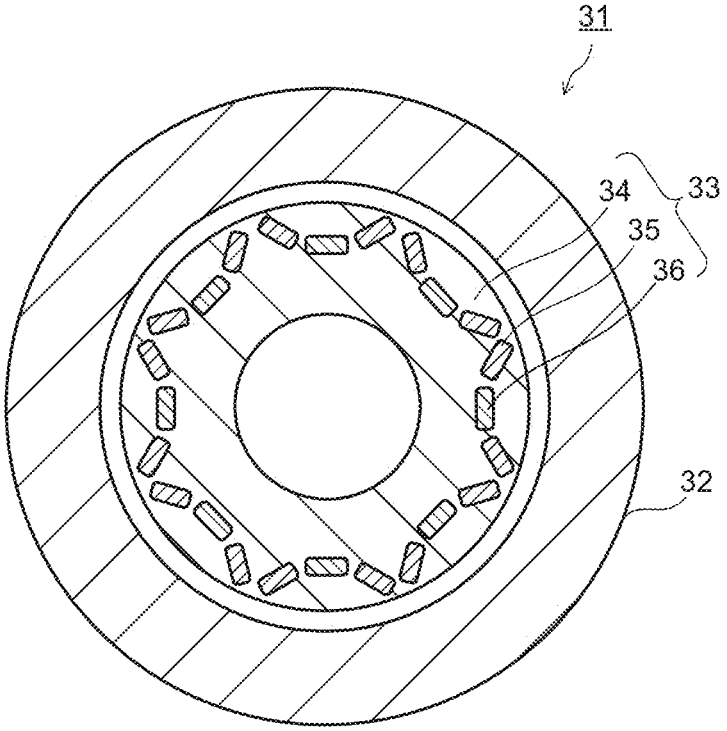
FIG. 3 is a schematic view illustrating a structure example of a variable magnetic flux motor.

FIG. 3 is a schematic view illustrating a structure example of a variable magnetic flux motor. In the variable magnetic flux motor 31 illustrated in FIG. 3, a rotor 33 is in a stator 32. The permanent magnets of the first embodiment are in an iron core 34 of the rotor 33, each as a stationary magnet 35 or a variable magnet 36. The magnetic flux density (flux quantum) of the variable magnets 36 is variable. The variable magnets 36 have a magnetization direction perpendicular to a Q-axis direction and thus are not influenced by a Q-axis current and can be magnetized by a D-axis current. A magnetization winding (not illustrated) is on the rotor 33. When a current is passed through the magnetization winding from a magnetization circuit, its magnetic field acts directly on the variable magnets 36.

With the use of the permanent magnet of the first embodiment, the variable magnets 36 can have suitable coercive force. By changing the various conditions (aging treatment condition and so on) of the above-described manufacturing method, the coercive force is controlled to the range of not less than 100 kA/m nor more than 500 kA/m, for instance. The variable magnetic flux motor 31 is capable of outputting a large torque even with a small device size and thus is suitable as motors of vehicles such as hybrid vehicles and electric cars required to have a high-power and downsized motor.

Figure 4:
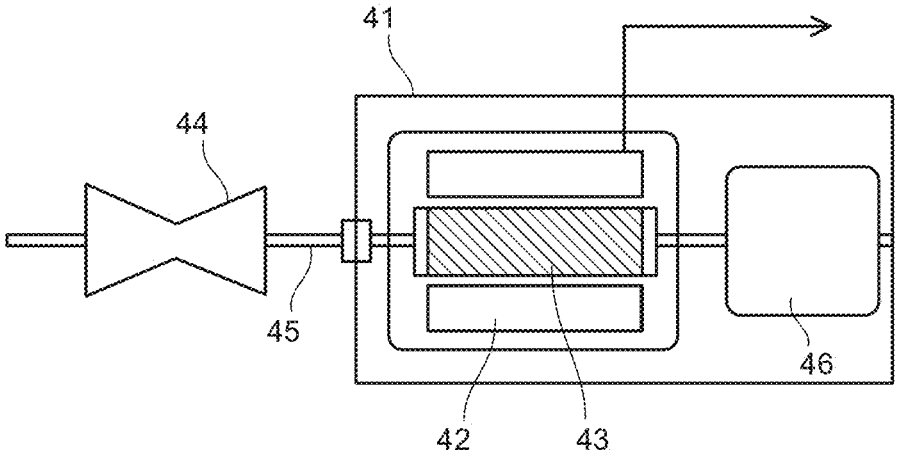
FIG. 4 is a schematic view illustrating a structure example of a generator.

FIG. 4 is a schematic view illustrating a structure example of a generator. The generator 41 illustrated in FIG. 4 includes a stator 42 including the above-described permanent magnet. A rotor 43 in the stator 42 connects via a shaft 45 to a turbine 44 which is at one end of the generator 41. The turbine 44 is rotated by, for example, an externally supplied fluid. Instead of rotating the turbine 44 by the fluid, the shaft 45 can be rotated by dynamic rotation transmitted thereto, such as regenerative energy of a vehicle such as an automobile. Various known structures are adoptable for the stator 42 and the rotor 43.

The shaft 45 is in contact with a commutator (not illustrated) which is on an opposite side of the turbine 44 across the rotor 43, and electromotive force generated by the rotation of the rotor 43 passes as an output of the generator 41 through an isolated phase bus and a main transformer (not illustrated), where it is boosted to a system voltage, and the boosted voltage is transmitted. The rotor 43 is electrically charged due to static electricity from the turbine 24 and an axial current accompanying power generation. Accordingly, the generator 41 includes a brush 46 for discharging the charged electricity of the rotor 43.

As described above, applying the above-described permanent magnet to a variable magnetic flux generator can bring about the effects of efficiency enhancement, downsizing, cost reduction, and so on.

Figure 5:
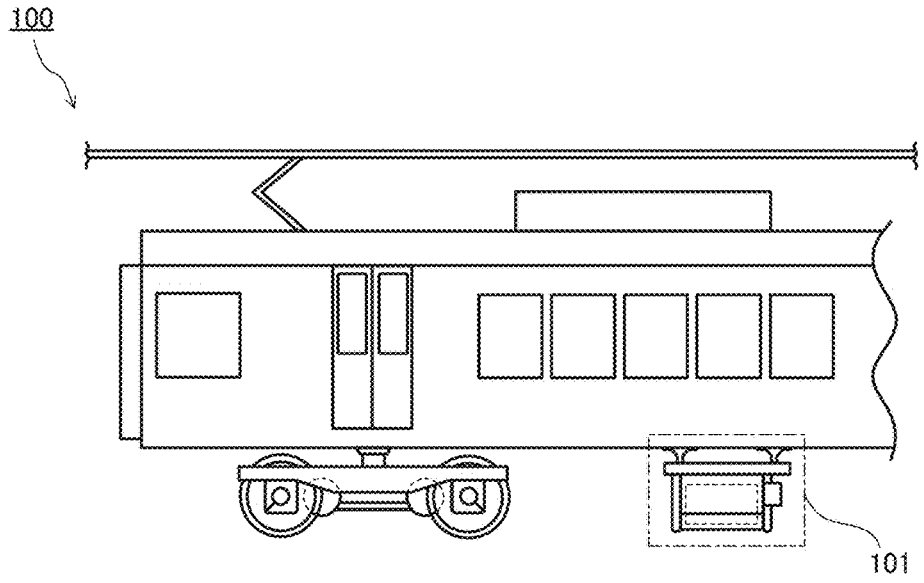
FIG. 5 is a schematic view illustrating a structure example of a railway vehicle.

The above-described rotary electrical machine may be mounted in, for example, a railway vehicle (an example of the vehicle) used for railway traffic. FIG. 5 is a schematic view illustrating a structure example of a railway vehicle. The railway vehicle 100 illustrated in FIG. 5 includes a rotary electrical machine 101. The rotary electrical machine 101 can be the motor in FIG. 3, the generator in FIG. 4, or the like. Where the aforesaid rotary electrical machine is mounted as the rotary electrical machine 101, the rotary electrical machine 101 may be, for example, a motor that is caused to output driving force by power supplied from an overhead wire or power supplied from a secondary battery mounted in the railway vehicle 100, or a generator which converts kinetic energy into power and supplies the power to various loads in the railway vehicle 100. Using a high-efficiency rotary electrical machine like the rotary electrical machine of the embodiment enables the energy-saving traveling of the railway vehicle.

Figure 6:
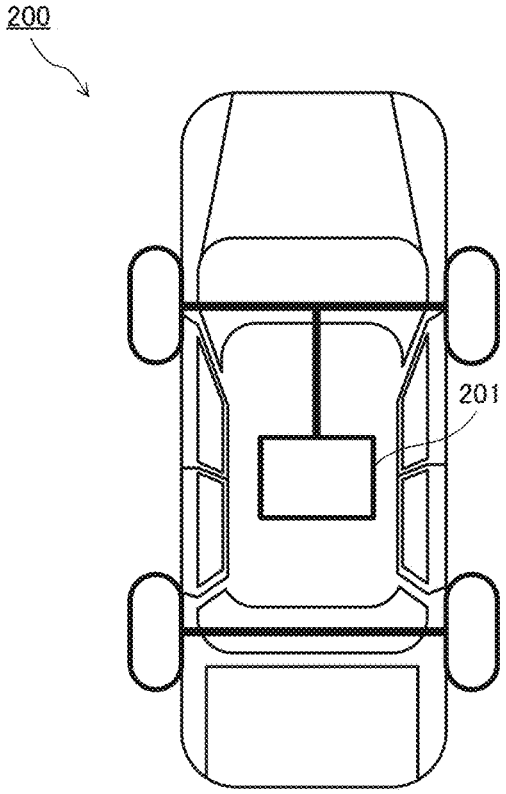
FIG. 6 is a schematic view illustrating a structure example of an automobile.

The above-described rotary electrical machine may be mounted in an automobile (another example of the vehicle) such as a hybrid car or an electric car. FIG. 6 is a schematic view illustrating a structure example of an automobile. The automobile 200 illustrated in FIG. 6 includes a rotary electrical machine 201. The rotary electrical machine 201 can be the motor in FIG. 3, the generator in FIG. 4, or the like. Where the above-described rotary electrical machine is mounted as the rotary electrical machine 201, the rotary electrical machine 201 may be a motor that outputs driving force of the automobile 200, or a generator that converts kinetic energy, which is generated when the automobile 200 is traveling, into power. Further, the aforesaid rotary electrical machine may be mounted in, for example, an industrial apparatus (industrial motor), an air-conditioning apparatus (air-conditioner/water heater compressor motor), an aero-generator, or an elevator (winch).

EXAMPLE 1

Example 1

After raw materials were weighed with the composition shown in Table 1, an alloy ingot was fabricated by high-frequency melting. After roughly pulverized, the ingot was finely pulverized by a jet mill into an alloy fine powder with a 4 μm average particle size. The obtained fine powder was pressed into a green compact under a 1 t pressing pressure in a 2.0 T magnetic field.

The obtained green compact was sintered. In the sintering, it was increased in temperature up to 1210° C. in a vacuum and was held in this state for three hours.

Next, the sintered compact was subjected to solution heat treatment by being held at 1160° C. for twelve hours in an Ar atmosphere, and was cooled down to a room temperature at a 170° C./minute rate.

Next, the sintered compact having undergone the solution heat treatment was subjected to aging treatment by being heat-treated at 650° C. for forty hours in the Ar atmosphere, thereafter was gradually cooled down to 300° C. at a cooling rate of 1° C./minute, and was further cooled down to a room temperature. Through the above processes, a sintered magnet was obtained.

Further, a volume ratio of a $TbCu_7$ crystal phase, a variance of the Cu concentration, residual magnetization $M_r$, and coercive force iHc were measured in the sintered magnet. Table 2 shows these results.

Example 2

After raw materials were weighed with the composition shown in Table 1, an alloy ingot was fabricated by high-frequency melting. After roughly pulverized, the ingot was finely pulverized by a jet mill into an alloy fine powder with a 3 μm average particle size. The obtained fine powder was pressed into a green compact under a 1 t pressing pressure in a 2.0 T magnetic field.

The obtained green compact was sintered. In the sintering, it was increased in temperature up to 1210° C. in Ar and was held in this state for five hours.

Next, the sintered compact was subjected to solution heat treatment by being held at 1150° C. for twelve hours in an Ar atmosphere, and was cooled down to a room temperature at a 170° C./minute rate.

Next, the sintered compact having undergone the solution heat treatment was subjected to aging treatment by being heat-treated at 670° C. for twenty hours in the Ar atmosphere, thereafter was gradually cooled down to 400° C. at a cooling rate of 1.5° C./minute, and was further cooled down to a room temperature. Through the above processes, a sintered magnet was obtained.

Further, a volume ratio of a $TbCu_7$ crystal phase, a variance of the Cu concentration, residual magnetization $M_r$, and coercive force iHc were measured in the sintered magnet. Table 2 shows these results.

Example 3

After raw materials were weighed with the composition shown in Table 1, an alloy ingot was fabricated by high-frequency melting. After roughly pulverized, the ingot was finely pulverized by a jet mill into an alloy fine powder with a 4 μm average particle size. The obtained fine powder was pressed into a green compact under a 1 t pressing pressure in a 2.0 T magnetic field.

The obtained green compact was sintered. In the sintering, it was increased in temperature up to 1210° C. in Ar and was held in this state for five hours.

Next, the sintered compact was subjected to solution heat treatment by being held at 1140° C. for twenty hours in an Ar atmosphere, and was cooled down to a room temperature at a 170° C./minute rate.

Next, the sintered compact having undergone the solution heat treatment was subjected to aging treatment by being heat-treated at 660° C. for fifteen hours in the Ar atmosphere, thereafter was gradually cooled down to 200° C. at a cooling rate of 1° C./minute, and was further cooled down to a room temperature. Through the above processes, a sintered magnet was obtained.

Further, a volume ratio of a $TbCu_7$ crystal phase, a variance of the Cu concentration, residual magnetization $M_r$, and coercive force iHc were measured in the sintered magnet. Table 2 shows these results.

Comparative Example 1

After raw materials were weighed with the composition shown in Table 1, an alloy ingot was fabricated by high-frequency melting. After roughly pulverized, the alloy ingot was finely pulverized by a jet mill into an alloy fine powder with a 4 μm average particle size. The alloy fine powder was pressed into a green compact under a 1 t pressing pressure in a 2.0 T magnetic field. The green compact was sintered by being heated to 1220° C. in a vacuum and held in this state for three hours.

Next, the sintered compact was subjected to solution heat treatment by being held at 1150° C. for twenty hours in an Ar atmosphere, and was cooled down to a room temperature at a 140° C./minute rate.

Next, the sintered compact having undergone the solution heat treatment was subjected to aging treatment by being heat-treated at 720° C. for forty hours in the Ar atmosphere, thereafter was gradually cooled down to 400° C. at a cooling rate of 0.4° C./minute, and was further cooled down to a room temperature. Through the above processes, a sintered magnet was obtained.

Further, a volume ratio of a $TbCu_7$ crystal phase, a variance of the Cu concentration, residual magnetization $M_r$, and coercive force iHc were measured in the sintered magnet. Table 2 shows these results.

TABLE 11

| | Magnet Composition (at. %) (Other) Example 1: Nd, Example 2: Pr | | | | | |
|---|---|---|---|---|---|---|
| | Sm | Co | Fe | Cu | Zr | Other |
| Example 1 | 8.96 | 48.8 | 33 | 5 | 2 | 2.24 |
| Example 2 | 8.96 | 48.8 | 33 | 5 | 2 | 2.24 |
| Example 3 | 11.2 | 48.8 | 33 | 5 | 2 | 0 |
| Comparative Example 1 | 11.2 | 48.8 | 33 | 5 | 2 | 0 |

TABLE 2

| | Volume Ratio of $TbCu_7$ Crystal Phase (%) | Variance of Cu Concentration | $M_r$ (T) | iHc (kA/m) |
|---|---|---|---|---|
| Example 1 | 96 | 1.2 | 1.22 | 150 |
| Example 2 | 95 | 0.9 | 1.21 | 130 |
| Example 3 | 97 | 1.6 | 1.22 | 200 |
| Comparative Example 1 | 70 | 0.5 | 1.19 | 350 |

In the sintered magnets of the examples 1 to 3, the volume ratio of the $TbCu_7$ crystal phase out of constituent phases of a main phase is 95% or more, and the variance of the Cu concentration of the $TbCu_7$ crystal phase is 0.7 or more. Further, as is apparent from Table 2, in all of the sintered magnets of the examples 1 to 3, the residual magnetization is high and the coercive force is suitable for a variable magnet. On the other hand, in the permanent magnet of the comparative example 1, the volume ratio of the $TbCu_7$ crystal phase is low and the residual magnetization is low.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of manufacturing a permanent magnet, comprising:

preparing an alloy powder, the alloy powder being expressed by a composition formula: $R_pFe_qM_rCu_sCo_{100-p-q-r-s}$ where R is at least one element selected from the group consisting of rare-earth elements, M is at least one element selected from the group consisting of Zr, Ti, and Hf, p is a number satisfying $10.5 \leq p \leq 12.5$ atomic percent, q is a number satisfying $25 \leq q \leq 40$ atomic percent, r is a number satisfying $0.88 \leq r \leq 4.5$ atomic percent, and s is a number satisfying $3.5 \leq s \leq 10.7$ atomic percent;

press-forming the alloy powder in a magnetic field to form a green compact;

sintering the green compact to form a sintered compact;

performing a solution heat treatment on the sintered compact at a temperature of not less than 1100° C. nor more than 1180° C.; and performing an aging treatment on the compact after the solution heat treatment, the aging treatment including heating the compact at a temperature of not lower than 550° C. nor higher than 680° C. for not less than 1 hour nor more than 100 hours, and then cooling the compact at a cooling rate of not less than 0.1° C./minute nor more than 5° C./minute to a temperature of not lower than 20° C. nor higher than 500° C., wherein the magnet comprises a crystal grain having a main phase, the main phase including a $TbCu_7$ crystal phase, wherein a volume ratio of the $TbCu_7$ crystal phase to the main phase is 95% or more, wherein the $TbCu_7$ crystal phase has a variation in Cu concentration, and wherein each of the variation at a first surface portion of the magnet, the variation at a second surface portion of the magnet, the variation at a first inner portion of the magnet and the variation at a second inner portion of the magnet, is 0.7 or more.

2. The method according to claim 1, wherein the magnet gives an X-ray diffraction pattern having a relative intensity of a peak ascribed to a $Th_2Zn_{17}$ crystal phase at a diffraction angle 2θ of 37.5 degree or more and 38.5 degree or less to a maximum peak ascribed to the $TbCu_7$ crystal phase, the relative intensity being 0.4 or less.

3. The method according to claim 1, wherein the green compact is sintered at a temperature of not lower than 1180° C. nor higher than 1250° C. for not less than 0.5 hours nor more than 15 hours.

4. The method according to claim 1, further comprising performing a rapid cooling on the compact after the solution heat treatment before the aging treatment at a cooling rate of 150° C./minute or more to a room temperature.

5. The method according to claim 1, wherein the alloy powder is prepared by pulverizing an alloy ingot made of a casting and expressed by the composition formula, the alloy powder having an average particle size of not less than 2 μm nor more than 8 μm.

6. The method according to claim 1, wherein the green compact is sintered at a temperature of not lower than 1180° C. nor higher than 1250° C. for not less than 0.5 hours nor more than 15 hours, and wherein the magnet gives an X-ray diffraction pattern having a relative intensity of a peak ascribed to a $Th_2Zn_{17}$ crystal phase at a diffraction angle 2θ of 37.5 degree or more and 38.5 degree or less to a maximum peak ascribed to the $TbCu_7$ crystal phase, the relative intensity being 0.4 or less.

* * * * *